US007578371B2

(12) United States Patent
Allred, III et al.

(10) Patent No.: US 7,578,371 B2
(45) Date of Patent: Aug. 25, 2009

(54) UNIVERSAL HINGED TREADS FOR FOLDING ATTIC STAIRS

(76) Inventors: Philip Allred, III, 504 Avery Way Ct., Kernersville, NC (US) 27284; Joel Bennett, P.O. Box 10468, Greensboro, NC (US) 27404

( * ) Notice: Subject to any disclaimer, the term of this patent is extended or adjusted under 35 U.S.C. 154(b) by 283 days.

(21) Appl. No.: 11/261,083

(22) Filed: Oct. 28, 2005

(65) Prior Publication Data

US 2006/0090409 A1 May 4, 2006

Related U.S. Application Data

(60) Provisional application No. 60/622,961, filed on Oct. 28, 2004.

(51) Int. Cl.
*E06C 1/00* (2006.01)
*E04F 11/06* (2006.01)

(52) U.S. Cl. ..... 182/163; 52/183

(58) Field of Classification Search ..... 52/182, 52/183, 188, 177, 179; 182/163, 156, 159, 182/228.1

See application file for complete search history.

(56) References Cited

U.S. PATENT DOCUMENTS 335,051 A * 1/1886 Ayres ..... 182/120
1,040,313 A * 10/1912 Handy ..... 182/156
1,243,304 A * 10/1917 Jurkowski ..... 182/29
1,514,055 A * 11/1924 Lawson ..... 108/100
1,791,330 A * 2/1931 Sprague ..... 182/21
1,818,428 A * 8/1931 Paysen ..... 52/183
2,333,849 A * 11/1943 Driscoll ..... 182/21
2,509,206 A * 5/1950 Buckner ..... 182/156
2,596,521 A * 5/1952 Bell ..... 182/156
2,736,482 A * 2/1956 Borden et al. ..... 182/78
2,815,159 A * 12/1957 Harmon ..... 182/78
2,907,401 A * 10/1959 Wagner ..... 182/78
3,035,671 A * 5/1962 Sicherman ..... 52/183
3,394,947 A * 7/1968 Strube, Sr. ..... 280/166
3,422,923 A * 1/1969 Lund ..... 182/120
3,564,790 A * 2/1971 Rehfeld ..... 52/183
3,807,528 A * 4/1974 Frank ..... 182/81
4,180,142 A * 12/1979 Sevillano et al. ..... 182/77
4,198,070 A * 4/1980 Weiler ..... 182/91
4,285,177 A * 8/1981 Seegers ..... 52/179
4,312,423 A * 1/1982 Helbig ..... 182/46
4,462,486 A * 7/1984 Dignan ..... 182/91
4,542,805 A * 9/1985 Hamlin et al. ..... 182/91
4,586,586 A * 5/1986 Canals ..... 182/118
4,893,442 A * 1/1990 Graham et al. ..... 52/184
4,899,504 A * 2/1990 Hirschhorn ..... 182/93
4,930,797 A * 6/1990 Parrill ..... 280/166
5,158,151 A * 10/1992 Chang ..... 182/159

(Continued)

*Primary Examiner*—Gay Ann Spahn
(74) *Attorney, Agent, or Firm*—Timothy M. Barlow

(57) ABSTRACT

A universal hinged tread system includes a folding stair set with one or more primary treads. At least one auxiliary tread is hingedly attached atop at least one primary tread. The folding stair set includes at least two hingedly attached sections. The hingedly attached sections fold flat against each other when in a stowed position, and every other folding stair section is inverted when in the stowed position. Each auxiliary tread is angularly displaced from its primary tread as its folding stair section is inverted. The auxiliary treads do not obstruct any primary treads on other sections when in a stowed position. The auxiliary treads include a beveled lower front edge to aid the auxiliary treads in deflecting.

7 Claims, 4 Drawing Sheets

U.S. PATENT DOCUMENTS 5,195,610 A * 3/1993 Chang ..... 182/156
5,220,757 A * 6/1993 Hulligan ..... 182/47
5,239,795 A * 8/1993 Breaux ..... 52/182
5,337,857 A * 8/1994 Spalt et al. ..... 182/122
5,357,876 A * 10/1994 Kniefel et al. ..... 108/92
D389,588 S * 1/1998 Dunk ..... D25/69
5,735,586 A * 4/1998 Cheng ..... 312/235.1
5,779,208 A * 7/1998 McGraw ..... 248/238
5,887,540 A * 3/1999 Krish, Jr. ..... 114/362
6,145,621 A * 11/2000 Nye ..... 182/159
6,182,598 B1 * 2/2001 Bozzo ..... 114/362
6,347,687 B1 * 2/2002 Alim ..... 182/161
6,471,002 B1 * 10/2002 Weinerman ..... 182/91
6,786,300 B1 * 9/2004 Bonifacini ..... 182/120
6,962,125 B1 * 11/2005 Wesley ..... 114/362
7,096,998 B1 * 8/2006 Edmunds ..... 187/200
2003/0056686 A1 * 3/2003 Morlok ..... 105/443
2004/0026173 A1 * 2/2004 Hillebrecht et al. ..... 182/159
2005/0173191 A1 * 8/2005 Linzmayer ..... 182/127
2006/0006023 A1 * 1/2006 Lim ..... 182/127
2006/0124398 A1 * 6/2006 Parker ..... 182/207
2006/0150315 A1 * 7/2006 Sumpton et al. ..... 4/621
2007/0034450 A1 * 2/2007 Richey ..... 182/77

* cited by examiner

UNIVERSAL HINGED TREADS FOR FOLDING ATTIC STAIRS

PRIORITY DATA

This application is a claims priority from U.S. Provisional Patent Application Ser. No. 60/622,961 filed on Oct. 28, 2004, entitled "Universal Hinged Treads for Folding Attic Stairs" and is hereby incorporated by reference.

FIELD OF THE INVENTION

This invention relates generally to the field of ladders and stairs, and more specifically to an auxiliary tread system for ladders and stairs.

BACKGROUND OF THE INVENTION

In many homes and businesses, pull-down attic stairs are a necessary evil. Typical applications for these stairs are where additional storage space is required, but nothing is available in the structure except for an attic crawl space.

If an attic crawl space is all that is available, then the occupants will need to determine a quick, cheap and reliable means of accessing the attic. A portable utility ladder is one solution, however, portable utility ladders are too portable. They are not very stable at times, and require a spotter for safety. In addition, ladders are easily taken away and used for other purposes, which effectively prevents access to the attic.

One solution to this problem is a set of pull-down attic stairs. These stairs are permanently attached to a ceiling panel and mounted between ceiling studs. One end of the panel is attached to the ceiling with a hinge, and the other end of the panel can be pulled down away from the ceiling. The unhinged end is biased up toward the ceiling with a large spring mechanism. After the panel is pulled down, a set of stairs is unfolded down to the floor. This device is an easy way to have a permanent, easily accessible set of stairs available, but these stairs have several shortcomings.

The first shortcoming is that the individual treads are quite shallow, when measured from front to back. Shallow treads do not inspire confidence when ascending and descending; only a very limited amount of the user's foot is in contact with each tread. Manufacturers do not make the treads any deeper because deeper treads will extend beyond the frame and interfere with the treads on other sections of the folding stairs. For these manufacturers, in order to enable the treads to be deeper, the frame must be made larger. This is not a good solution where manufacturers are trying to control material costs, and the larger stairs may not fit into the available ceiling space.

For those whose existing stairs have these shortcomings, the solutions are either to replace the entire folding stair set, or to add deeper treads to the existing stair set. Replacing the entire stair set can be quite expensive and time-consuming.

Thus, what is desired is a set of deep treads that are easily attached to an existing stair set. The treads should be large enough to inspire confidence when ascending and descending, but should not interfere in any way with the function of the stair set.

It is intended that any other advantages and objects of the present invention that become apparent or obvious from the detailed description or illustrations contained herein are within the scope of the present invention.

SUMMARY OF THE INVENTION

The device is a universal hinged tread system that has auxiliary treads for attachment to the primary treads on an existing stair set. Each auxiliary tread includes a hinge pin that is incorporated into the auxiliary tread. The auxiliary tread and its hinge pin can be formed as an integral unit from a high-strength plastic. A hinge plate is fastened to the primary tread and traps the hinge pin against the primary tread. Where the deployed auxiliary tread bears against the hinge plate, the auxiliary tread is relieved to compensate for the thickness of the hinge plate. Thus, the auxiliary tread bears evenly against the hinge plate and the primary tread. The auxiliary tread is deeper, measured from front to back, than the original primary tread. The auxiliary tread and the hinge plate are approximately even with the back side of the primary tread. The extra depth of the auxiliary tread hangs over and extends from the front of the primary tread. This provides are greater surface area for the user and inspires greater confidence in ascending and descending the stairs.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

Figure 1:
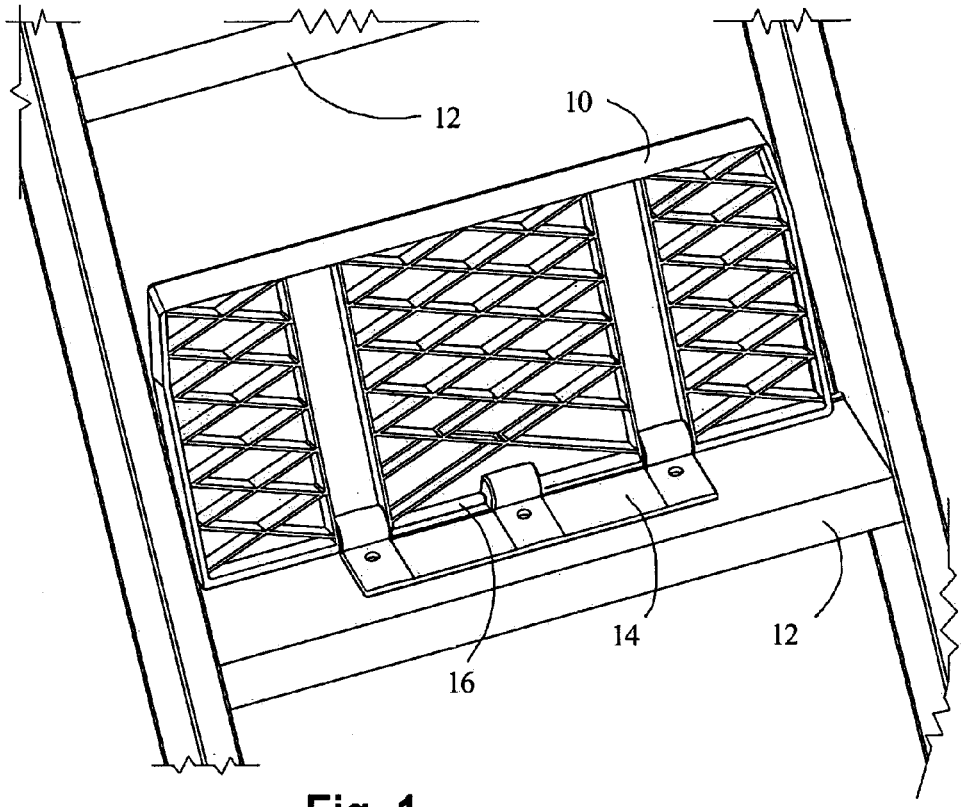
FIG. 1. is a perspective view of a universal hinged tread system, with the auxiliary treads attached to the primary treads, according to the present invention.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DETAILED DESCRIPTION OF THE INVENTION

The following detailed description is of the best presently contemplated modes of carrying out the invention. This description is not to be taken in a limiting sense, but is made merely for the purpose of illustrating general principles of embodiments of the invention.

Referring now to the drawings, the attached figures illustrate a system having universal hinged treads for folding attic stairs.

FIG. 1. is a perspective view of a universal hinged tread system, with the auxiliary treads 10 attached to the primary treads 12. Each auxiliary tread 10 includes a hinge pin 16 that is incorporated into the auxiliary tread 10. The auxiliary tread 10 and its hinge pin 16 can be formed as an integral unit from a high-strength plastic. Alternatively, the auxiliary treads 10 may be made from lumber, such as plywood, and door hinges or other common equivalents. A hinge plate 14 is fastened to the primary tread 12 and traps the hinge pin 16 against the primary tread 12. Where the deployed auxiliary tread 10 bears against the hinge plate 14, the auxiliary tread 10 is relieved to compensate for the thickness of the hinge plate 14. Thus, the auxiliary tread 10 bears evenly against the hinge plate 14 and the primary tread 12. The auxiliary tread 10 is deeper, measured front to back, than the primary tread 12. The auxiliary tread 10 and the hinge plate 14 are approximately even with the back side of the primary tread 12. The extra depth of the auxiliary tread 10 hangs over and extends from the front of the primary tread 12. This provides are greater surface area for the user and inspires greater confidence in ascending and descending the stairs.

Figure 2:
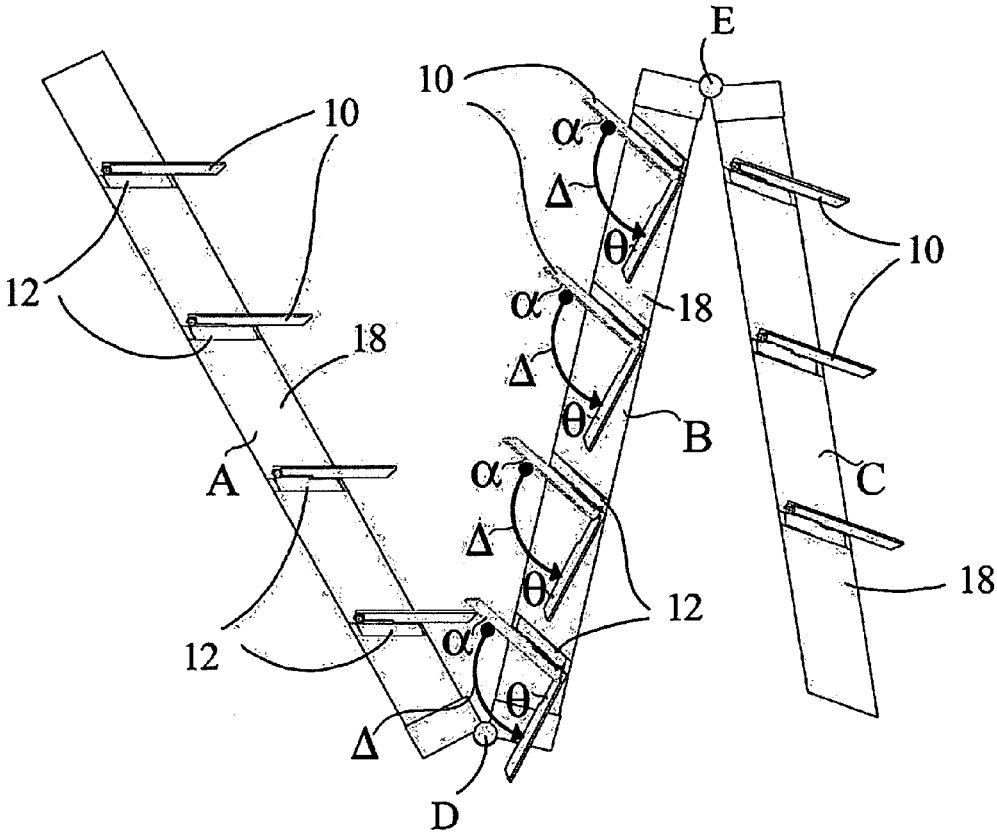
FIG. 2. is a side view of the universal hinged tread system, partially folded, according to the present invention.

FIG. 2 is a side view of the universal hinged tread system, where the stairs are partially folded. Each of the primary treads 12 has an auxiliary tread 10 attached via a hinge. The folding stair set shown includes three hingedly attached sections. The upper section A attaches into a ceiling or similar support at it upper end. The center section B is attached via a hinge D to the bottom of the upper section A. The lower section C is attached via hinge E to the bottom of the center section B. The hinges D,E between these sections A,B,C are arranged so that they fold flat against each other when in a stowed position. As FIG. 2 shows, every other folding stair section is inverted when in the stowed position. In this case, section B is inverted as the stairs are stowed. As section B is inverted, each auxiliary tread 10 is angularly displaced Δ from its primary tread 12. This displacement occurs due to gravity. No springs, biasing means or power is required. The auxiliary treads 10 are displaced Δ from a deployed position α to a stowed position θ. The auxiliary treads 10 do not obstruct any primary treads 12 when in the stowed position θ. This is important because the auxiliary treads 10 extend a significant distance beyond the primary treads 12 and their stringers 18. If the auxiliary treads 10 did not move from their deployed position α, they could interfere with the primary treads 12 on sections A and C.

Figure 3:
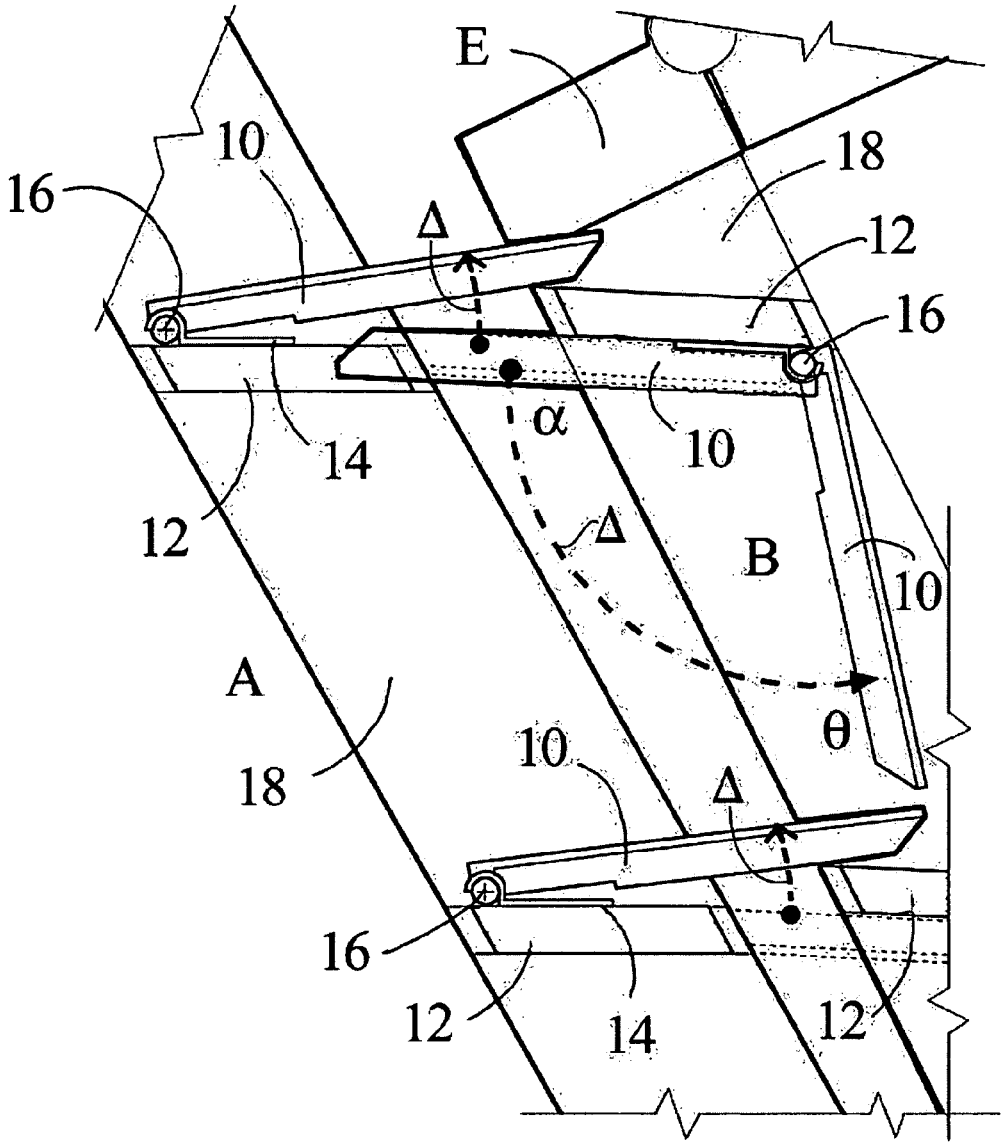
FIG. 3 is a side view of the universal hinged tread system, almost completely folded, according to the present invention.

FIG. 3 is a side view of the universal hinged tread system, where the stairs are almost completely folded. In this view, section B is almost flat against section A. The auxiliary treads 10 on section B have displaced Δ from α to θ, due to gravity, and will not interfere with the treads 10, 12 on section A. However, due to the layout of the primary treads 12 on many folding stair sets, there is still a possibility of interference between the auxiliary treads 10 of an upright stair section, such as section A, and the primary treads 12 on an inverted stair section, such as section B. In these cases, it is necessary for the auxiliary treads 10 on section A to deflect slightly in response to contact with the primary treads 12 on section B. FIG. 3 shows this interaction. Notice that the auxiliary treads 10 on section A are deflected Δ upward about 15 degrees in response to contact with the inverted primary treads 12 of section B. To enable this deflection Δ, the auxiliary treads 10 include a beveled lower front edge. This bevel acts as a ramp or cam to lift or deflect the auxiliary tread 10 away from the interference. The hinged auxiliary treads 10 on the upright stair sections, such as sections A and C, are most useful on folding stair sets where the primary treads 12 on adjoining sections A,B,C are closely arranged or almost touching when stowed, such as shown in FIG. 4.

Figure 4:
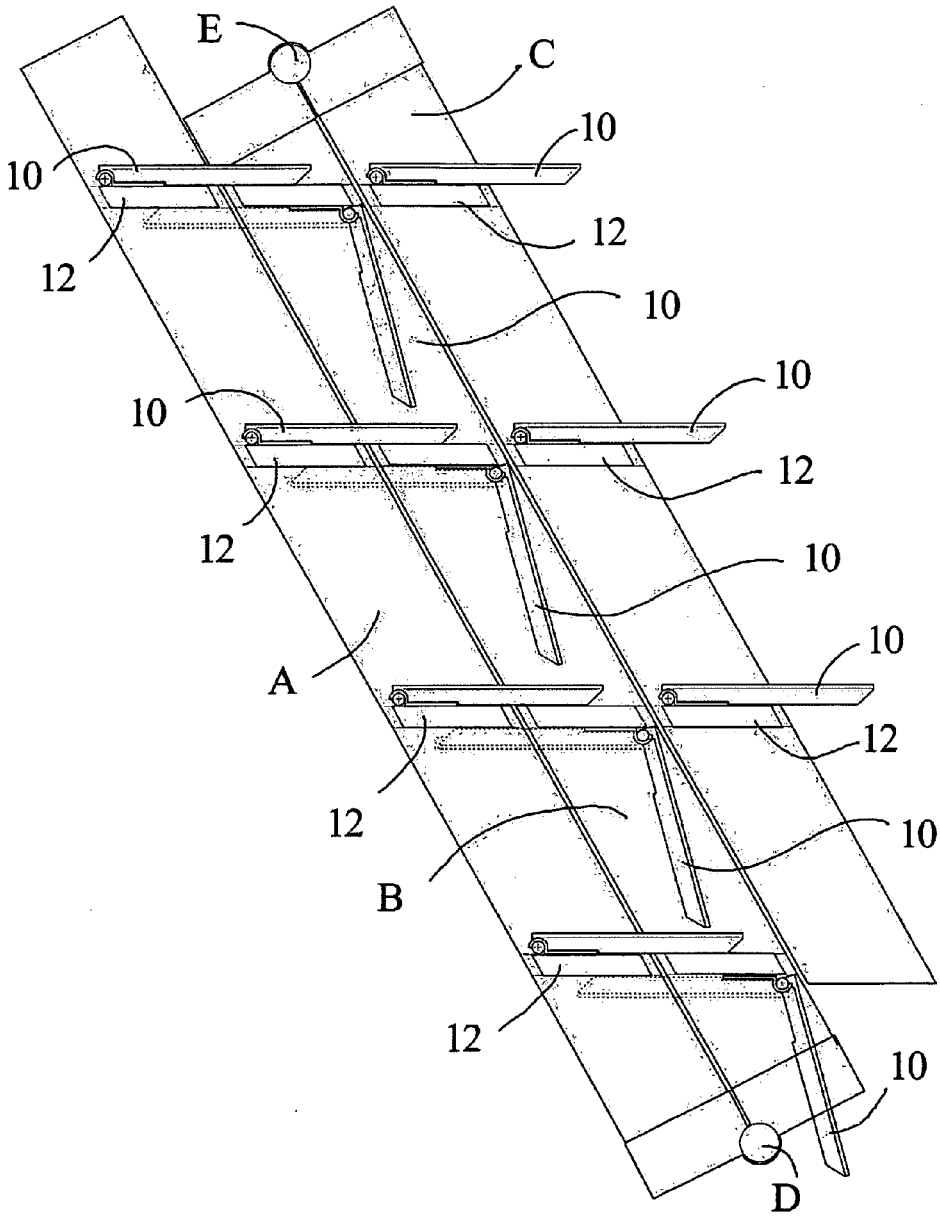
FIG. 4 is a side view of the universal hinged tread system, partially extended, according to the present invention.

FIG. 4 is a side view of the universal hinged tread system, where the stairs are completely stowed. Notice that the primary treads 12 on each of the adjoining sections are about even. This arrangement of primary treads 12 creates the interference that necessitates the deflection of the auxiliary treads 10 on section A. The auxiliary treads 10 on section A are now laying flat against the primary treads 12 of both sections A and B. Each of the auxiliary treads 10 on section B have been displaced and are now simply hanging from the hinges 16.

Redeployment of the folding stair set is simply the reverse operation. Sections C and B are unfolded from A. The auxiliary treads 10 of section A are briefly deflected as the section B is separated from section A. The stair sections, A,B,C are unfolded to their full extension, and as section B is extended, its auxiliary treads 10 automatically fall from 2 to ∀, due to gravity. The automatic deployment of the auxiliary treads occurs when the angle between ∀ and 2 is less than 90 degrees. Alternatively, the stowed position 2 may include an angle, greater than 90 degrees from ∀, that requires the user to move the auxiliary treads 10 to position ∀.

In an alternative embodiment, a stair set may be made without the usual primary treads 12. In this case, the stair set includes a frame with a set of stringers and a plurality of hinged auxiliary treads 10 mounted to the stringers. As above, each auxiliary tread 10 is deeper than the stringers. However, because there are no primary treads 12 to support the auxiliary treads 10, the hinge is attached directly to the stringers and provides the horizontal support for the auxiliary treads 10. As another embodiment, the auxiliary treads 10 may be used without hinges and primary treads 12. In this case, the deep auxiliary treads 10 are attached directly to the stringers without any hinges. Small brackets o could be used to secure the treads 10 to the stringers, or a flange could be incorporated into the treads 10. As shown in FIG. 4, the auxiliary treads 10 cannot simply be placed where the primary treads 12 are. As the stair set is folded, the auxiliary treads 10 would contact and interfere. In order to avoid this issue, the auxiliary treads 10 need to be shifted collectively a few inches up or down the stringers. In that manner the stair set would have large, evenly-spaced treads, and could also be folded flat for storage.

While the description above refers to particular embodiments of the present invention, it will be understood that many modifications may be made without departing from the spirit thereof. The accompanying claims are intended to cover such modifications as would fall within the true scope and spirit of the present invention.

We claim:

1. A universal hinged tread system comprising:

a folding stair set further comprising a plurality of primary treads fixed to a pair of generally parallel stringers;

a plurality of auxiliary treads, wherein each of the auxiliary treads is hingedly attached atop a separate one of the plurality of primary treads with a tread hinge, wherein the tread hinge includes a hinge pin which is oriented to a rear edge of both the primary tread and the auxiliary tread, wherein the auxiliary tread bears against the primary tread when the auxiliary tread is pivoted away from a stowed position and into a deployed position.

2. The universal hinged tread system of claim 1, where the folding stair set comprises at least two hingedly attached sections, an upper section and a lower section, each section including a set of stringers, one or more of the plurality of primary treads, wherein at least one of the plurality of auxiliary treads is hingedly attached to one of the plurality of primary treads, wherein the hingedly attached sections, in a deployed position, are arranged generally parallel to a long axis of the stringers.

3. The universal hinged tread system of claim 2, where the at least two hingedly attached sections, including at least a first section and a second section corresponding to the upper section and lower section, are adapted to fold flat against each other when in a stowed position.

4. The universal hinged tread system of claim 3, where the second hingedly attached section of the folding stair set is inverted with respect to the first section, when in the stowed position.

5. The universal hinged tread system of claim 4, where the auxiliary tread of the second folding stair section is angularly displaced, by gravity, from its primary tread at its tread hinge as the second folding stair section is moved into the stowed position.

6. The universal hinged tread system of claim 1, where the auxiliary treads permit access to a top surface of any of the plurality of primary treads when the plurality of auxiliary treads are in a stowed position.

7. The universal hinged tread system of claim 1, where the auxiliary treads include a beveled lower front edge as a cam, wherein the auxiliary treads are deflectable away from a point of interference.

* * * * *